US005967003A

United States Patent [19]

Lin

[11] Patent Number: 5,967,003

[45] **Date of Patent: *Oct. 19, 1999**

[54] RATCHET SCREW DRIVER

[76] Inventor: Ching Chou Lin, No. 150, Sec. 3, Chung San Rd., Wu Zh Hsiang, Taichung Hsien, Taiwan

[ * ] Notice: This patent is subject to a terminal disclaimer.

[21] Appl. No.: 09/009,637

[22] Filed: Jan. 20, 1998

[51] Int. Cl.[6] ..... B25B 13/46

[52] U.S. Cl. ..... 81/58.3; 81/60

[58] Field of Search ..... 81/58, 58.3, 60; 192/48.92

[56] References Cited

U.S. PATENT DOCUMENTS 1,553,850 9/1925 Davis ..... 81/58.3

1,627,441 5/1927 Lawyer ..... 81/58.3

5,782,146 7/1998 Lin ..... 81/58.3

*Primary Examiner*—James G. Smith

*Attorney, Agent, or Firm*—Charles E. Baxley, Esq.

[57] ABSTRACT

A ratchet screw driver includes a handle having a tube and having a number of ratchet teeth and a driving stem rotatably engaged in the tube. A follower is slidably engaged on the driving stem and includes a number of ratchet teeth for engaging with the ratchet teeth of the handle. A spring may bias the ratchet teeth of the follower to engage with the ratchet teeth of the handle for allowing the driving stem to be rotated in an active direction by the handle and to be rotated freely relative to the handle when the handle is rotated in the reverse direction.

6 Claims, 3 Drawing Sheets

RATCHET SCREW DRIVER

BACKGROUND OF THE INVENTION

1. Field of the Invention

The present invention relates to a screw driver, and more particularly to a ratchet screw driver.

2. Description of the Prior Art

Typical screw drivers comprise a driving shaft engaged in a handle for driving fasteners. A number of ratchet mechanisms are engaged in the handle for allowing the driving shaft to be rotated in an active direction and to be rotated freely in the opposite direction. However, the ratchet mechanism includes a complicated configuration. In addition, the tool bits may not be received in the handle in which the ratchet mechanism is engaged therein.

The present invention has arisen to mitigate and/or obviate the afore-described disadvantages of the conventional screw drivers.

SUMMARY OF THE INVENTION

The primary objective of the present invention is to provide a ratchet screw driver which includes a simplified configuration and which includes a mechanism for receiving the driving shaft and the tool bits.

In accordance with one aspect of the invention, there is provided a ratchet screw driver comprising a handle including a tube and including a plurality of ratchet teeth, a driving stem rotatably engaged in the tube, a follower slidably engaged on the driving stem and rotated in concert with the driving stem, the follower including a plurality of ratchet teeth for engaging with the ratchet teeth of the handle, and means for biasing the follower toward the ratchet teeth of the handle and for biasing the ratchet teeth of the follower to engage with the ratchet teeth of the handle. The driving stem and the follower are adapted to be rotated by the handle when the handle is rotated in an active direction, and the driving stem and the follower are adapted to be rotated freely relative to the handle when the handle is rotated in a reverse direction. The tool includes a greatly simplified ratchet mechanism. In addition, the driving stem may be received in the handle.

The handle includes a base and a cover secured to the base, the tube is secured to the base, the base and the cover each includes an opening, the driving stem includes two ends engaged in the openings of the base and the cover.

The tube includes a non-circular hole, the handle further includes a ring having an extension, the extension includes a non-circular cross section for engaging with the non-circular hole of the tube and for allowing the ring to be rotated in concert with the tube, the ratchet teeth of the handle are formed on the ring. The driving stem includes an annular groove, the ring includes at least one projection for engaging with the annular groove and for rotatably securing the driving stem to the tube.

The tube includes a first end having at least one notch and includes a stop having at least one protrusion for engaging with the at least one notch and for securing the stop to the tube, the biasing means includes a spring engaged between the stop and the follower for biasing the follower toward the ratchet teeth of the tube. The driving stem includes an annular groove, the stop includes at least one projection for engaging with the annular groove and for rotatably securing the driving stem to the tube.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

A co-pending U.S. patent application was filed on Feb. 19, 1997, with the Ser. No. 08/802,093. The co-pending U.S. patent application is taken as a reference for the present invention.

Figure 1:
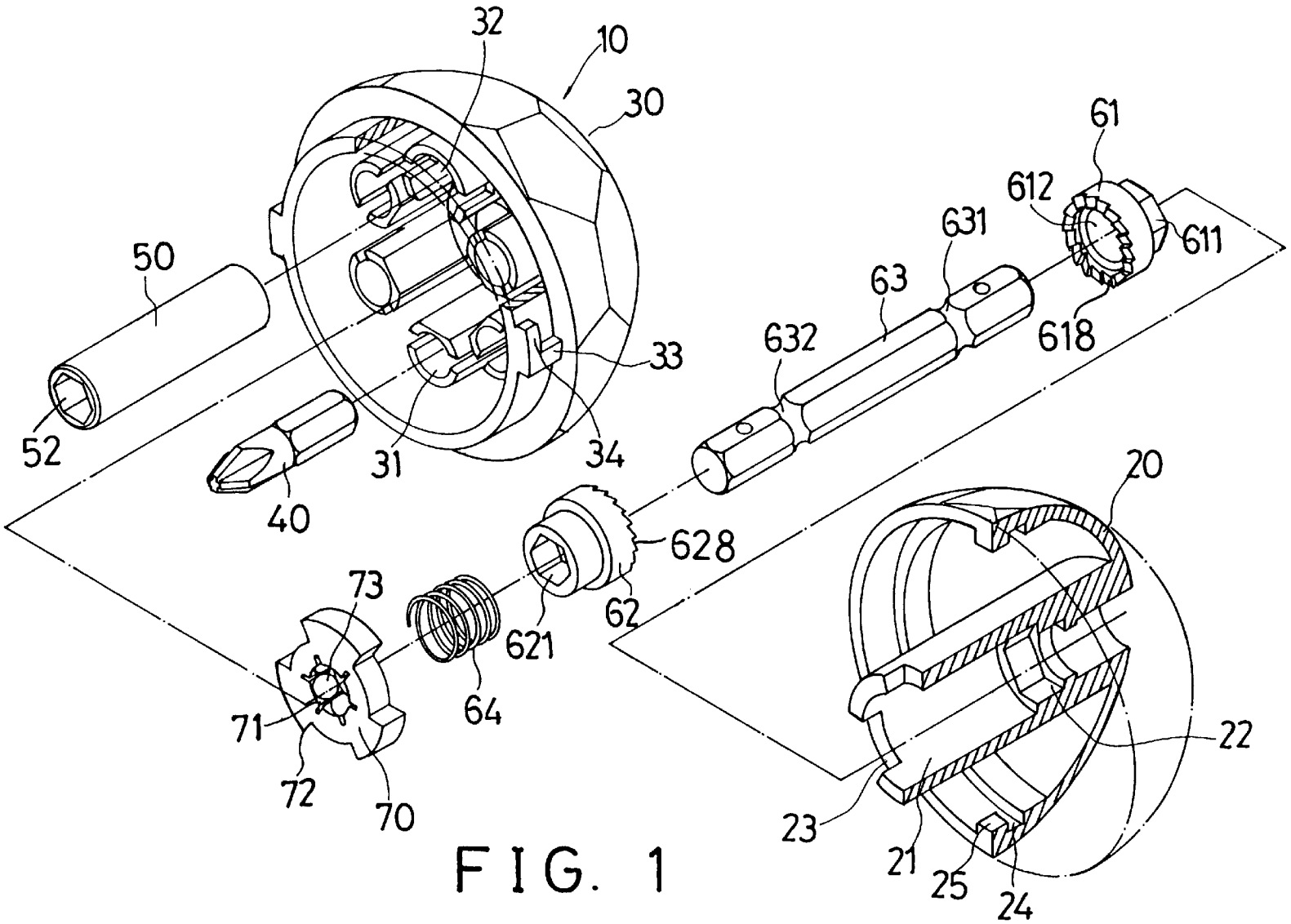
FIG. 1 is an exploded view of a ratchet screw driver in accordance with the present invention.
Figure 3:
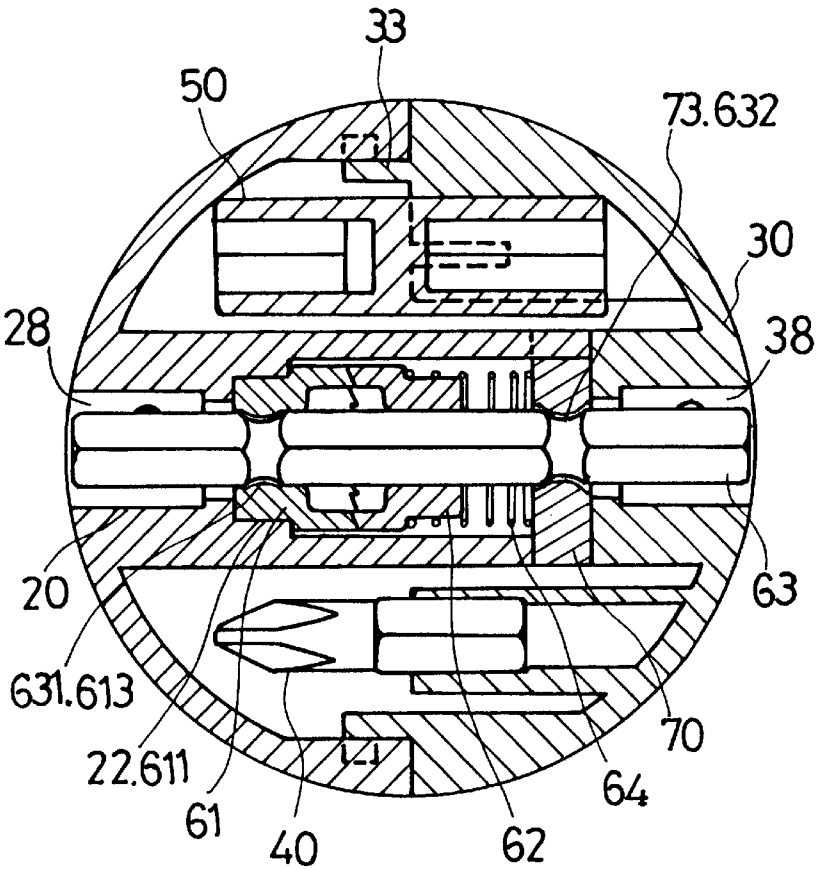
FIG. 3 is a cross sectional view taken along lines 3—3 of FIG. 2.
Figure 2:
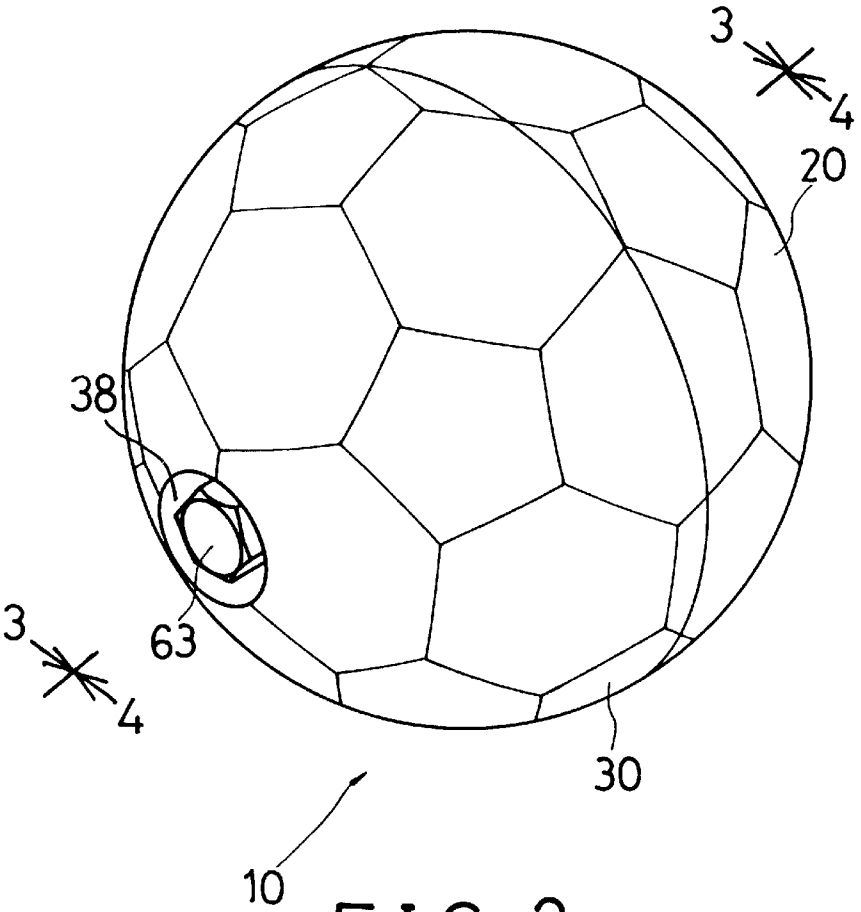
FIG. 2 is a perspective view of the ratchet screw driver.

Referring to the drawings, and initially to FIGS. 1 to 3, a ratchet screw driver in accordance with the present invention comprises a handle 10 including a base 20 and a cover 30 secured together for forming a spherical or olivary shape or other similar shapes. The base 20 and the cover 30 each includes a semi-spherical or semi-olivary shape. The base 20 includes a tube 21 having one or more notches 23 formed in one end and having a non-circular hole 22 formed in the other end portion. The base 20 includes an annular shoulder 24 and one or more juts 25. The cover 30 includes one or more latches 33 each having a key 34 for engaging with the annular shoulder 24 and for securing the cover 30 to the base 20. The cover 30 includes a number of engaging cavities 31, 32 for engaging with tool bits 40 and/or sockets 50 and/or other tool members. The base 20 and the cover 30 each includes an opening 28, 38 (FIG. 3) for engaging with the socket 50.

A ring 61 includes a bore 612 and includes a number of ratchet teeth 618 and includes an extension 611 having a non-circular cross section for engaging with the non-circular hole 22 of the tube 21 and for securing the ring 61 to the base 20 by such as force-fitted engagement. The ring 61 thus may be rotated in concert with the base 20. A driving stem 63 is slidably engaged through the bore 612 of the ring 61 and through the tube 21 and includes two annular grooves 631, 632. The ring 61 includes one or more projections 613 (FIGS. 3–5) for engaging with the annular groove 631 of the driving stem 63 and for rotatably securing the driving stem 63 to the base 20. A follower 62 includes a non-circular aperture 621 for slidably engaging on the driving stem 63 and for allowing the follower 62 to be rotated in concert with the driving stem 63. The follower 62 includes a number of ratchet teeth 628 for engaging with the ratchet teeth 618 of the ring 61. A stop 70 includes one or more protrusions 72 for engaging with the notches 23 of the tube 21 and for securing the stop 70 to the tube 21 by such as force-fitting engagement. The stop 70 includes a hole 71 for engaging with the driving stem 63 and includes one or more projections 73 (FIGS. 3–5) for engaging with the annular groove 632 of the driving stem 63 and for rotatably securing the driving stem 63 to the tube 21. A spring 64 is engaged between the follower 62 and the stop 70 for biasing the ratchet teeth 628 of the follower 62 to engage with that of the ring 61.

Alternatively, the ring 61 may also be formed as an integral portion of the tube 21; i.e., the tube 21 may include a number of ratchet teeth 618. The driving stem 63 may be struck and moved relative to the handle 10 for disengaging the projections 613, 73 from the annular grooves 631, 632 such that the driving stem 63 may be disengaged from the handle 10 when required.

Figure 4:
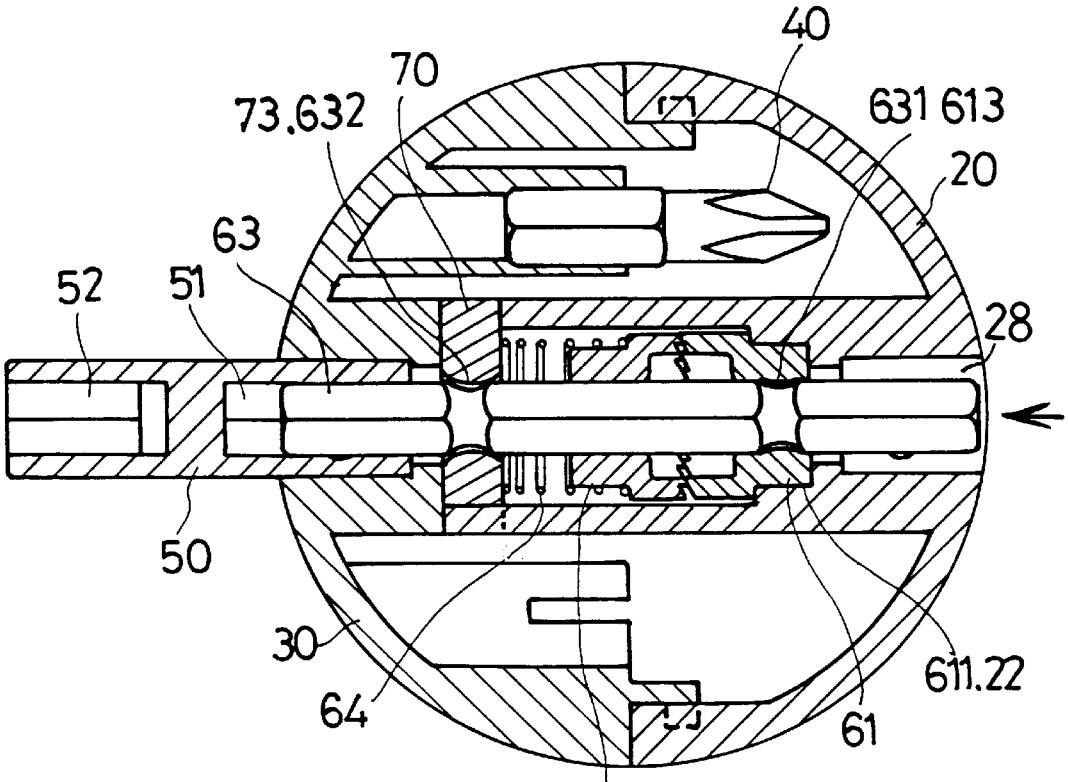
FIG. 4 is a cross sectional view taken along lines 4—4 of FIG. 2.
Figure 5:
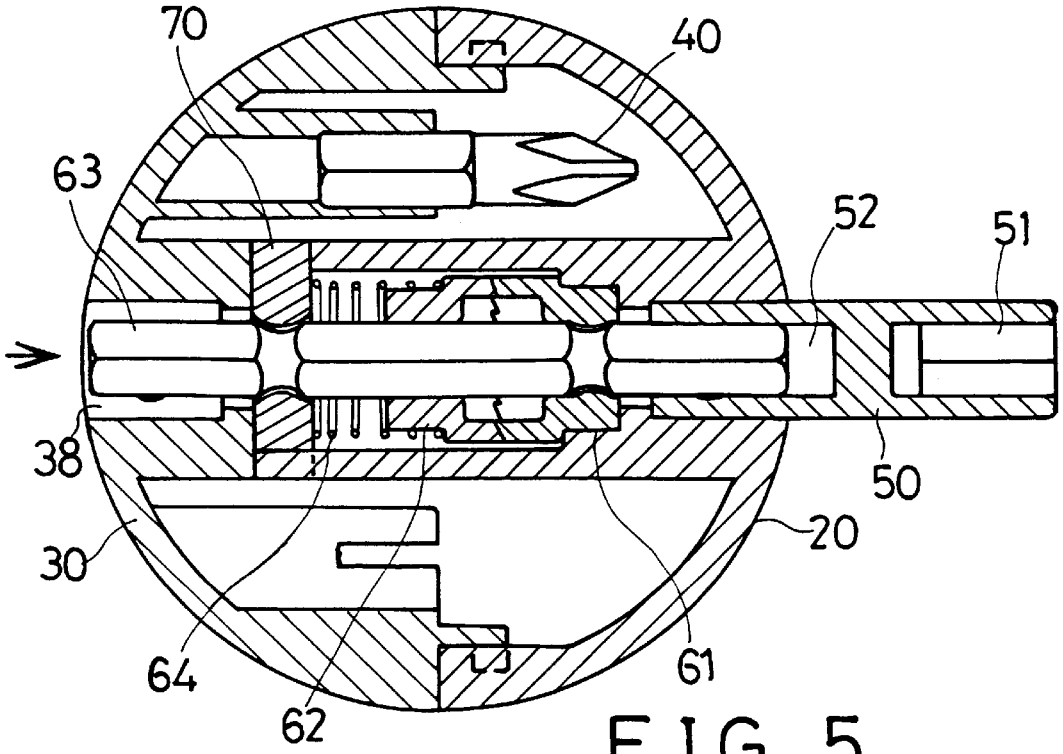
FIG. 5 is a cross sectional view similar to FIG. 4, illustrating the operation of the ratchet screw driver.

In operation, as shown in FIGS. 4 and 5, the socket 50 includes one end for engaging with either of the openings 28, 38 of the base 20 and the cover 30 and includes an engaging hole 51 (FIG. 4) for engaging with the driving stem 63 and for allowing the socket 50 to be driven by the driving stem 63. The socket 50 may includes another engaging hole 52 (FIG. 5) for engaging with the driving stem 63.

As shown in FIG. 4, when viewing toward the base 20 in the direction as shown in the arrow of FIG. 4 and when rotate the handle 10 in one direction, clockwise for example, the follower 62 may be rotated by the ring 61 and by the engagement of the ratchet teeth 618, 628 such that the socket 50 and the driving stem 63 may also be rotated clockwise. However, when the handle 10 is rotated in the reverse direction, counterclockwise for example, the follower 62 may not be rotated counterclockwise by the handle 10 due to the engagement of the ratchet teeth 618, 628.

On the contrary, as shown in FIG. 5, when the socket 50 is engaged with the other end of the driving stem 63 via the opening 28 of the base 20 and when rotate the handle 10 clockwise, the follower 62 may not be rotated clockwise by the ring 61 due to the engagement of the ratchet teeth 618, 628. However, when the handle 10 is rotated counterclockwise, the follower 62 may be rotated counterclockwise by the handle 10 by the engagement of the ratchet teeth 618, 628 such that the socket 50 and the driving stem 63 may also be rotated counterclockwise.

It is to be noted that the tool includes a greatly simplified configuration and includes a driving stem that may be engaged within the handle.

Accordingly, the ratchet screw driver in accordance with the present invention includes a simplified configuration and includes a mechanism for receiving the driving shaft and the tool bits.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet screw driver comprising:

a handle including a tube and including a plurality of ratchet teeth, a driving stem rotatably engaged in said tube, a follower slidably engaged on said driving stem and rotated in concert with said driving stem, said follower including a plurality of ratchet teeth for engaging with said ratchet teeth of said handle, and means for biasing said follower toward said ratchet teeth of said handle and for biasing said ratchet teeth of said follower to engage with said ratchet teeth of said handle, said driving stem and said follower being adapted to be rotated by said handle when said handle is rotated in an active direction, and said driving stem and said follower being adapted to be rotated freely relative to said handle when said handle is rotated in a reverse direction.

2. A ratchet screw driver according to claim 1, wherein said handle includes a base and a cover secured to said base, said tube is secured to said base, said base and said cover each includes an opening, said driving stem includes two ends engaged in said openings of said base and said cover.

3. A ratchet screw driver according to claim 1, wherein said tube includes a non-circular hole, said handle further includes a ring having an extension, said extension includes a non-circular cross section for engaging with said non-circular hole of said tube and for allowing said ring to be rotated in concert with said tube, said ratchet teeth of said handle are formed on said ring.

4. A ratchet screw driver according to claim 3, wherein said driving stem includes an annular groove, said ring includes at least one projection for engaging with said annular groove and for rotatably securing said driving stem to said tube.

5. A ratchet screw driver according to claim 1, wherein said tube includes a first end having at least one notch and includes a stop having at least one protrusion for engaging with said at least one notch and for securing said stop to said tube, said biasing means includes a spring engaged between said stop and said follower for biasing said follower toward said ratchet teeth of said tube.

6. A ratchet screw driver according to claim 5, wherein said driving stem includes an annular groove, said stop includes at least one projection for engaging with said annular groove and for rotatably securing said driving stem to said tube.

* * * * *